US005452901A

United States Patent [19]

Nakada et al.

[11] Patent Number: 5,452,901

[45] Date of Patent: Sep. 26, 1995

[54] REMOTE CONTROLLABLE TOY

[75] Inventors: Takashi Nakada, Saitama; Masaaki Nitobe, Tochigi, both of Japan

[73] Assignee: Kabushiki Kaisha B-AI, Japan

[21] Appl. No.: 267,372

[22] Filed: Jun. 29, 1994

[30] Foreign Application Priority Data

Dec. 16, 1993 [JP] Japan ..... 5-343562

[51] Int. Cl.[6] ..... A63H 30/04

[52] U.S. Cl. ..... 273/310; 273/311; 273/85 G; 273/86 B; 446/175; 446/454; 446/455; 446/456

[58] Field of Search ..... 273/310–316, 273/148 B, 85 G, 438, 85 R, 86 B; 446/175, 454–456; 345/158, 161

[56] References Cited

U.S. PATENT DOCUMENTS

| | | | |
|---|---|---|---|
| 3,444,646 | 5/1969 | Domashovetz | 446/175 |
| 4,810,224 | 3/1989 | De Vincent | 446/230 |
| 4,828,525 | 5/1989 | Okano | 446/175 |
| 4,924,216 | 5/1990 | Leung | 273/148 B |
| 4,938,843 | 7/1990 | Yavetz | 273/311 |
| 4,987,349 | 1/1991 | Nakamura | 446/175 |
| 5,098,110 | 3/1992 | Yang | 273/438 |
| 5,127,658 | 7/1992 | Openiano | 273/311 |

*Primary Examiner*—Jessica J. Harrison
*Assistant Examiner*—Kerry Owens
*Attorney, Agent, or Firm*—R. Gale Rhodes, Jr.

[57] ABSTRACT

A remote controllable toy including a plurality of passive toy units, a plurality of transmitters for remotely controlling the passive toy units, and synchronizing signal transmitting means for transmitting a synchronizing signal to the passive toy units and the transmitters. Each of the transmitters of the passive toy units transmits a control signal for controlling the corresponding passive toy unit when identifying a transmission timing allocated thereto by referring to the synchronizing signal. Each of the passive toy units receives both the synchronizing signal and the control signal, and identifies the timing allocated thereto by referring to the received synchronizing signal, so that it is actuated in accordance with the control signal received within the timing allocated thereto.

7 Claims, 8 Drawing Sheets

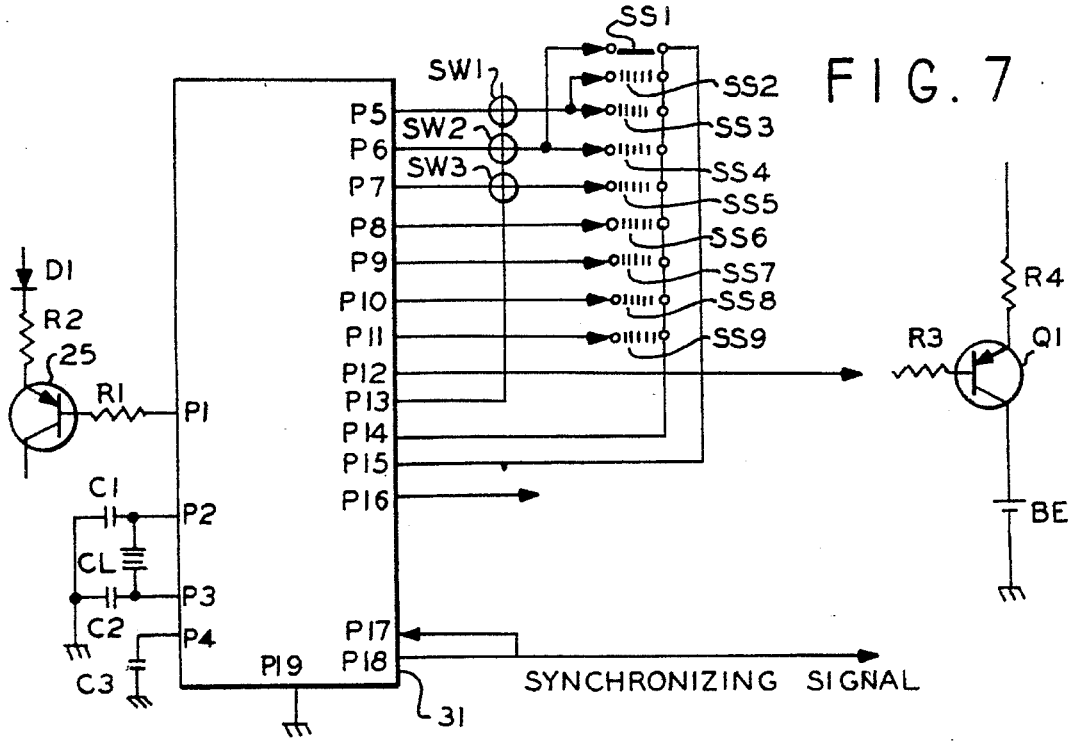
FIG. 7
FIG. 8
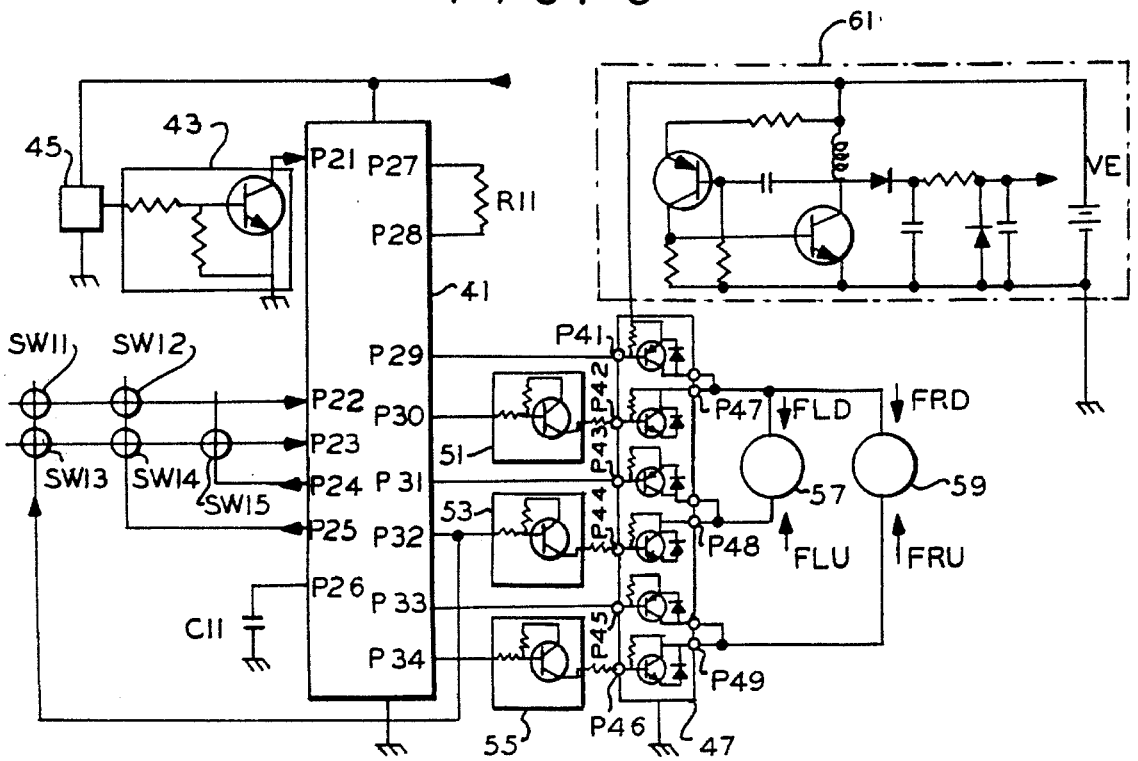

REMOTE CONTROLLABLE TOY

BACKGROUND OF THE INVENTION

1. Field of the Invention

This-invention relates to a remote controllable toy in which plural passive toy units are remotely controllable individually and substantially simultaneously, and particularly to a remote controllable toy for use in a game in which plural passive toy units are remotely controlled to perform game and play functions, for example to vie with one another in strength and speed.

2. Description of Related Art

Various kinds of remote controllable toy units in which a controllable toy unit is remotely controlled by transmitting infrared radiation from a transmitter to the toy unit have been conventionally proposed. These toy units are mainly used in cases where only one person remotely controls one toy unit using one transmitter for the toy unit. On the other hand, a game where a plurality of toy units and transmitters for the toy units are prepared for a number of players may be considered, with the players individually and remotely controlling the respective toy units which are individually allocated to the players, thereby allowing these toy units to do battle with one another.

In this case, when the infrared beams transmitted from the transmitters have the same wavelength and a number of players simultaneously transmit the infrared beams from their transmitters, the toy units which are allocated to these players cannot be controlled due to the infrared beams from the transmitters interfering with each other. In order to overcome this problem, it is proposed that wavelengths of infrared beams transmitted as control signals are set for each transmitter such that the infrared radiation transmitted from the respective transmitters have the different wavelength.

However, if the wavelengths of the infrared beams transmitted as control signals are individually set for each transmitter so that the infrared beams transmitted from the respective transmitters have different wavelengths, the respective passive toy units must be designed to receive an infrared beam having a corresponding wavelength. In order to satisfy this requirement, a specific transmitting circuit for transmitting an infrared beam whose wavelength is individually set for each transmitter is installed in each transmitter, and in addition a specific receiving circuit for receiving the infrared beam having a corresponding wavelength is installed in each passive toy unit.

Accordingly, there exists a need for a remote controllable toy which includes a plurality of toy units and corresponding transmitters wherein the cost of manufacture is reduced without a sacrifice in operation and playability of the toy units.

SUMMARY OF THE INVENTION

It is the object of the present invention to satisfy the foregoing need in the remote controllable toy art.

Remote controllable toy satisfying the foregoing need and embodying the present invention includes a plurality of passive toy units and a corresponding plurality of transmitters. The transmitters transmit control signals to the passive toy units and a synchronizing signal is transmitted to all passive toy units and all transmitters to identify which transmitter is to transmit a control signal to its corresponding passive toy unit and this permits the same receiver circuit to be installed in each passive toy unit and the same transmitting circuit to be installed in each transmitter. In one embodiment, the synchronizing signal transmitter is a separate unit, and in a second embodiment the synchronizing signal transmitter is included in one of the transmitters and in a third embodiment the synchronizing signal transmitter is included in one of the passive toy units.

BRIEF DESCRIPTION OF THE DRAWINGS

FIG. 7 is a circuit diagram showing the construction of a synchronizing signal transmitting circuit which may be installed into a passive toy unit;

FIG. 8 is a circuit diagram showing the construction of a synchronizing signal transmitting circuit installed into a passive toy unit;

DETAILED DESCRIPTION OF PREFERRED EMBODIMENTS

Preferred embodiments according to this invention will be described with reference to the accompanying drawings.

Figure 4:
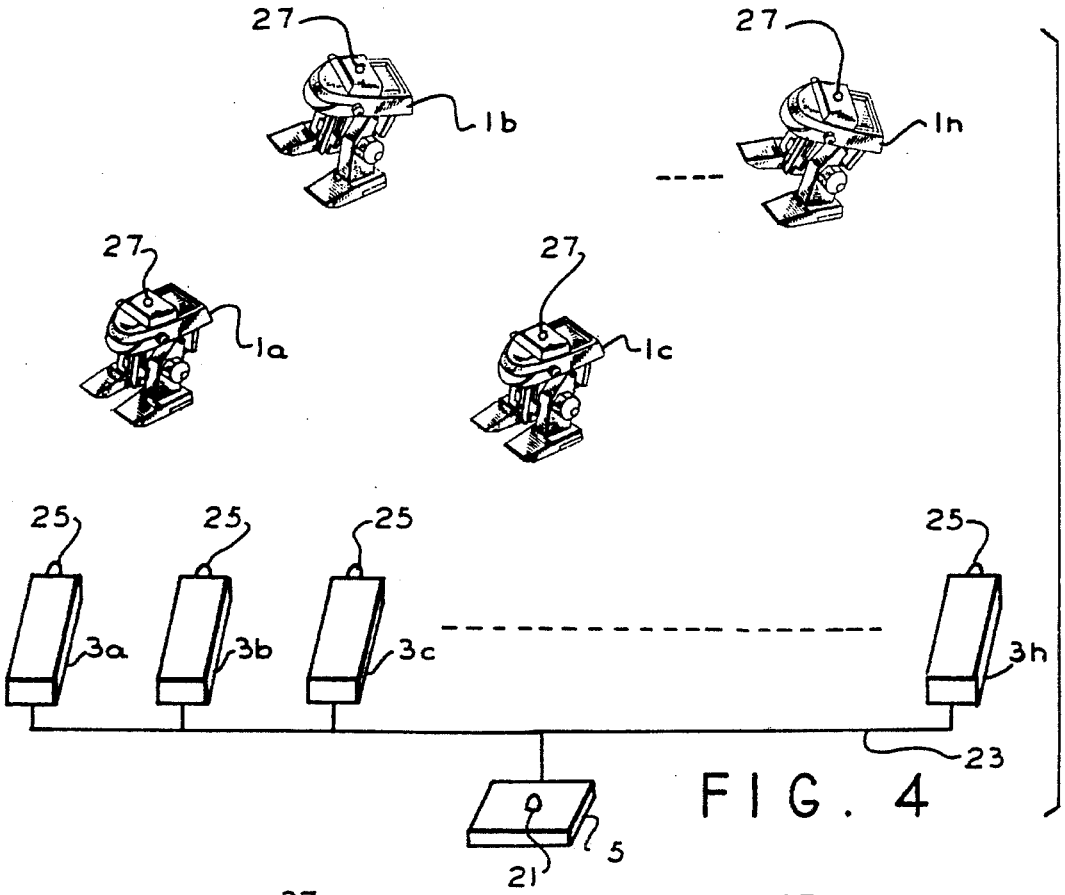
FIG. 4 is a diagrammatical illustration of the first embodiment of the present invention and corresponds to FIG. 1.

As shown in FIG. 4, the first embodiment of a remote controllable toy comprises a plurality of passive toy units 1*a*, 1*b*, 1*c*, . . . , 1*n*, and a plurality of transmitters 3*a*, 3*b*, 3*c*, . . . , 3*n* for remotely controlling the passive toy units 1*a*, 1*b*, 1*c*, . . . , 1*n* respectively, and a synchronizing signal transmitting means 5 for transmitting a synchronizing signal as shown in FIG. 11(A). The synchronizing signal transmitting means 5 includes a synchronizing signal generating circuit for generating a synchronizing Signal of a predetermined time period, and a light emitting element 21 for emitting an infrared beam of predetermined wavelength. The synchronizing signal transmitting means 5 is connected to the plurality of transmitters 3*a*, 3*b*, 3*c*, . . . , 3*n* through a signal line, and transmits the synchronizing signal to each of the transmitters 3*a*, 3*b*, 3*c*, . . . , 3*n* through the signal line 23. Further, the synchronizing signal transmitting means 5 actuates the light emitting element 21 to transmit the synchronizing signal of the infrared beam to the plurality of passive toy units 1*a*, 1*b*, 1*c*, . . . , 1*n*.

Each of the transmitters 3*a*, 3*b*, 3*c*, . . . , 3*n* is designed to refer or respond to the synchronizing signal and transmit a control signal for controlling the corresponding passive toy unit 1*a*, 1*b*, 1*c*, . . . , 1*n* only when it identifies a transmission timing, or period of operation, allocated to the transmitter. That is, each of the transmitters 3*a*, 3*b*, 3*c*, . . . , 3*n* has a light emitting element 25 for emitting an infrared beam of the same predetermined wavelength as the synchronizing signal transmitting means 5, and transmits the infrared beam control signal by actuating the light emitting element 25. Each of the passive toy units 1*a*, 1*b*, . . . , 1*n* has a light receiving element 27 for receiving the infrared beam of predetermined wavelength, and receives both the synchronizing signal and the control signal as described above through the light receiving element 27. By referring or responding to the received synchronizing signal, each passive toy unit identifies the timing, or period of operation, allocated thereto, and is actuated in accordance with the control signal received within the timing.

Figure 5:
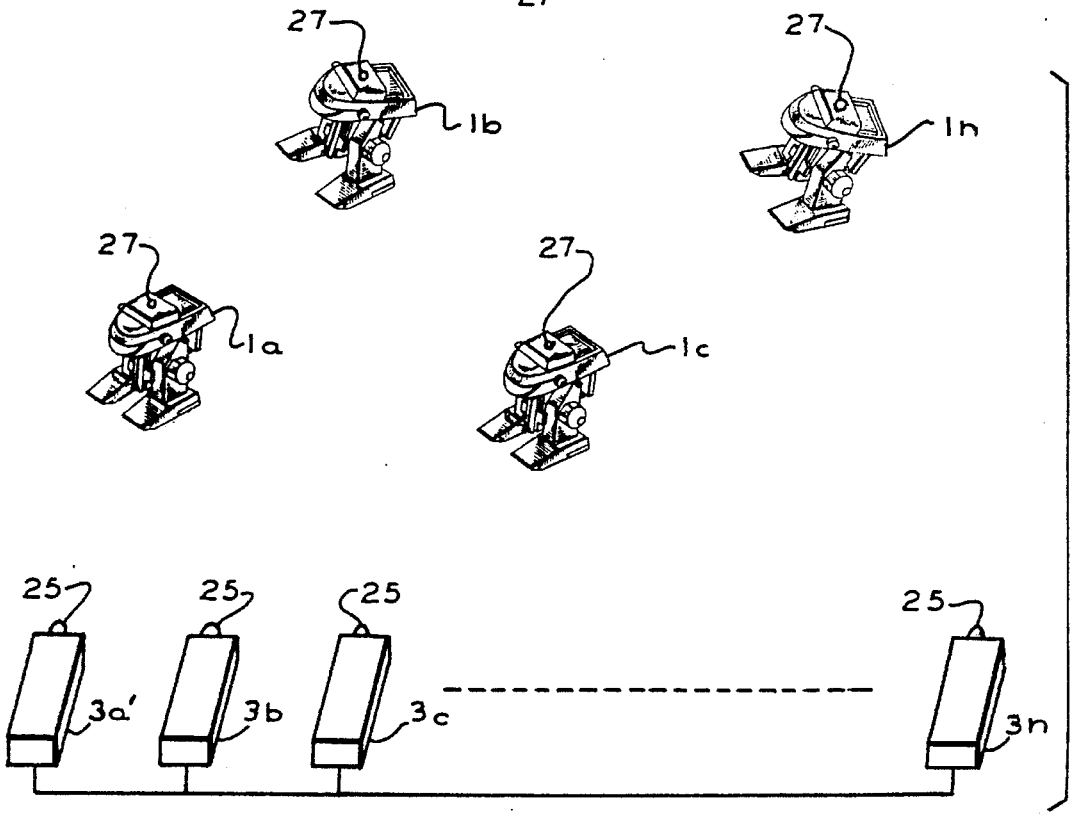
FIG. 5 is a diagrammatical illustration of the second embodiment of the present invention and corresponds to FIG. 2.

The remote controllable toy of the second embodiment of FIG. 5 includes a plurality of passive toy units 1*a*, 1*b*, 1*c*, . . . , 1*n*, and a plurality of transmitters 3*a*', 3*b*, 3*c*, . . . , 3*n* for remotely controlling the passive toy units 1*a* . . . , 1*n*, and any one transmitter of the plurality of such transmitters, for example, the transmitter 3*a* is provided with a synchronizing signal transmitting means (not shown) for example synchronizing signal transmitting means 5 of FIG. 4. The synchronizing signal transmitting means 5 is connected to the other transmitters 3*b*, 3*c*, . . . , 3*n* through a signal line 23, and transmits a synchronizing signal through the signal line 23 to each of the transmitters 3*b*, 3*c*, . . . , 3*n*. Further, the transmitter 3*a* including the synchronizing signal transmitting means 5 actuates the light emitting element 25 to transmit an infrared beam synchronizing signal having a predetermined wavelength to the plurality of passive toy units 1*a*, 1*b*, 1*c*, . . . , 1*n*.

Each of the transmitters 3*a*', 3*b*, 3*c*, . . . , 3*n* refers or responds to the synchronizing signal, and transmits a control signal for controlling the corresponding passive toy unit 1*a*, 1*b*, 1*c*, . . . , 1*n* only when it identifies the synchronizing signal to indicate the transmission timing or period of operation allocated to the transmitter. That is, each of the transmitters 3*a*', 3*b*, 3*c*, . . . , 3*n* has a light emitting element 25 for emitting an infrared beam of predetermined wavelength, and actuates the light emitting element 25 to transmit the control signal of the infrared radiation. Each of the passive toy units 1*a*, 1*b*, . . . , 1*n* has a light receiving element 27 for receiving an infrared beam of predetermined wavelength, and receives both of the synchronizing signal and the control signal through the light receiving element 27. By referring or responding to the received synchronizing signal, it identifies the timing, or period of operation, allocated thereto and operates in accordance with the control signal received within the timing, or period of operation, allocated thereto.

Figure 6:
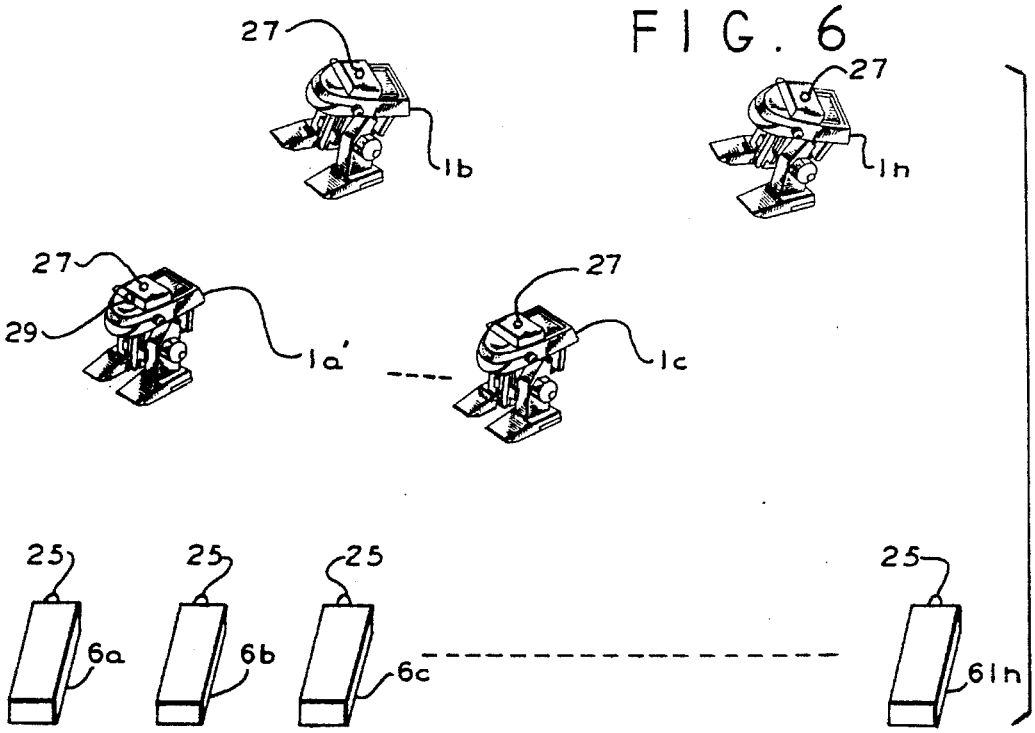
FIG. 6 is a diagrammatical illustration of the third embodiment of the present invention and corresponds to FIG. 3.

The remote controllable toy of the third embodiment of FIG. 6 includes a plurality of passive toy units 1*a*', 1*b*, . . . , 1*n*, and a plurality of transmitters 6*a*, 6*b*, . . . , 6*n* for remotely controlling the passive toy units. Any one of the plurality of passive toy units, for example the passive toy unit 1*a*', may be provided with the synchronizing signal transmitting means (not shown) such as signal transmitting means 5 of FIG. 4. The synchronizing signal transmitting means 5 of the passive toy unit 1*a*' has a light emitting element 29 for emitting an infrared beam of predetermined wavelength, and through the operation of the light emitting element 29, transmits an infrared beam synchronizing signal of the infrared radiation of predetermined wavelength to the other passive toy units 1*b*, 1*c*, . . . , 1*n* and the plurality of transmitters 6*a*, 6*b*, . . . , 6*n*.

Each of the transmitters 6*a*, 6*b*, 6*c*, . . . , 6*n* refers or responds to the synchronizing signal, and transmits a control signal for controlling the corresponding passive toy unit 1*a*', 1*b*, 1*c*, . . . , 1*n* only when it identifies the transmission timing, or period of operation, allocated thereto. That is, each of the transmitters 6*a*, 6*b*, 6*c*, . . . , 6*n* has a light emitting element 25 for emitting infrared radiation or infrared beam of predetermined wavelength and actuates the light emitting element 25 to transmit an infrared beam control signal. Each of the passive toy units 1*a*', 1*b*, 1*c*, . . . , 1*n* has a light receiving element 27 for receiving the infrared radiation of predetermined wavelength, and it receives both of the synchronizing signal and the control signal through the light receiving element 27. By referring or responding to the received synchronizing signal, it identifies the timing, or period of operation, allocated thereto, and operates in accordance with the control signal received within the timing, or period of operation, allocated thereto.

Next, by way of example, the detailed circuit construction of the transmitter 3*a*' as shown in FIG. 5 will be described with reference to FIG. 7.

An integrated circuit 31 as shown in FIG. 7 includes a microcomputer which performs various control processes. A terminal P1 of the integrated circuit 31 is connected to the light emitting element 25 through a resistor R1, and the light emitting element 25 is connected to a diode D1 through a resistor R2. Terminals P2 and P3 are connected to a quartz oscillator CL and capacitors C1 and C2. A terminal P4 is connected to a capacitor C3, and terminals P5, P6 and P7 are connected to switches SW1, SW2 and SW3. The switch SW1 serves to actuate the right leg of the corresponding passive toy unit, and the switch SW2 serves to actuate the left leg of the corresponding passive toy unit. The switch SW3 serves to speed up the operation of the corresponding passive toy unit. These switches SW1, SW2 and SW3 are connected to one terminal of slide switches SS1, SS2, SS3, SS4 and SS5. Terminals P8, P9, P10 and P11 are connected respectively to slide switches SS6, SS7, SS8 and SS9. The other terminals of the slide switches SS1 and SS2 are connected to a terminal P15, and these terminals of the slide switches SS3 to SS9 are connected to a terminal P14. Each of these slide switches SS1 to SS9 serves to set a transmission timing, or period of operation, allocated thereto. For example, by suitably setting the slide switches SS1 to SS9 in accordance with the number NO of each transmitter, a transmission timing inherent to the number NO of each transmitter is set. The terminal P18 serves to transmit the synchronizing signal to the other transmitters 3*b*, 3*c*, . . . , 3*n*. A power source circuit comprises a battery BE, a transistor Q1 and resistors R3 and R4, and supplies power to each part.

The integrated circuit 31 has a synchronizing signal generating circuit for generating a synchronizing signal on the basis of an oscillation signal from the quartz oscillator CL. The generated synchronizing signal is transmitted to the other transmitters 3*b*, 3*c*, . . . , 3*n* through the terminal P18 and signal line 23 (FIG. 5), and at the same time it is transmitted to the plurality of passive toy units 1*a*, 1*b*, . . . , 1*n* through the light emitting element 25. Accordingly, the synchronizing signal generating circuit and the circuit portion containing the light emitting element 25 constitute the synchronizing signal transmitting means 5. The integrated circuit 31 has a transmission timing identifying means (i.e. transmission timing identifying means 7 of FIG. 2) for identifying the transmission timing, or period of operation, allocated to itself by referring to the synchronizing signal. Described in further detail, the transmission timing identifying means 7 has a counter circuit. Upon input of the synchronizing signal as shown in FIG. 11(A), the number of pulses of the synchronizing signal which are input subsequently to a start code SRT is counted, and then the transmission timing, or period of operation, allocated to itself is identified on the basis of the count value.

In place of the counter circuit as described above, a timer circuit or the like may be used to measure a lapse time after a start code SRT is input and identify the transmission timing, or period of operation, allocated to itself on the basis of the measured value.

Further, the integrated circuit 31 has a control signal generating circuit for generating a control signal to control the corresponding passive toy unit only when the transmission timing identifying means 7 (FIG. 2) identifies the transmission timing, or period of operation, allocated thereto, and the generated control signal is transmitted to the plurality of passive toy units 1*a*, 1*b*, . . . , 1*n* through the light emitting element 25. Accordingly, the control signal generating circuit and the circuit portion containing the light emitting element 25 (FIG. 7) constitute the transmitting means 9 of transmitter 4*a* of FIG. 5. None of the other transmitters 3*b*, 3*c*, . . . , 3*n* includes synchronizing signal generating circuit. Except for the synchronizing signal generating circuit, the circuit construction of the other transmitters is identical to that of the transmitter 4*a*, and thus a detailed description thereof is omitted.

Next, by way of example, the construction of the circuit portion installed in the passive toy unit la shown in FIG. 5 will be described with reference to FIG. 8.

An integrated circuit 41 includes a microcomputer and conducts various control processes. A terminal P21 of the integrated circuit 41 is connected to a signal processing circuit 43, and the signal processing circuit 43 is connected to a light receiving circuit 45. The light receiving circuit 45 has a light receiving element (i.e. light receiving element 27 of FIGS. 1–3) for receiving an infrared beam of predetermined wavelength. The signal processing circuit 43 and the light receiving circuit 45 constitute the receiving means 11 (FIGS. 1–3), and receive both the synchronizing signal and the control signal in the form of infrared beams.

Further, the integrated circuit 41 has a timing identifying means for identifying the timing, or period of operation, allocated to itself by referring or responding to the received synchronizing signal. Described in further detail, the timing identifying means has a counter circuit. Upon input of the synchronizing signal as shown in FIG. 11(A), it counts the number of pulses of the synchronizing signal which is input subsequently to the start code SRT, and identifies the timing, or period of operation, allocated to itself on the basis of the count value.

In place of the counter circuit as described above, a timer circuit or the like may be used to measure a lapse time after a start code SRT is input and identify the transmission timing, or period of operation, allocated to itself on the basis of the measured value.

Terminals P22, P23, P24 and P25 of the integrated circuit 41 are connected switches SW11, SW12, SW13, SW14 and SW15. Each of the switches SW13, SW14 and SW15 serves to set the reception timing, or period of operation, allocated thereto. By suitably setting the switches SW13 to SW15 in accordance with the number NO of each passive toy unit for example, an inherent timing is individually set in accordance with the number NO of each passive toy unit. The switch SW11 serves to stop the operation. The switch SW12 serves to store a number NO in a memory of the integrated circuit 41. When the switch SW12 is operated in a state where any transmitter transmits a control signal, the same number NO as the transmitter which forcibly transmits the corresponding control signal is set irrespective of the setting of the switches SW13, SW14 and SW15. A terminal P26 is connected to a capacitor C11. A resistor R11 is connected between terminals P27 and P28. Terminals P29, P31 and P33 of the integrated circuit 41 are connected to terminals P41, P43 and P45 of a driving circuit 47 respectively, and terminals P30, P32 and P34 of the integrated circuit 41 are connected to terminals P42, P44 and P46 of the driving circuit 47 through driving control circuits 51, 53 and 55 respectively. A coil 57 for actuating the left leg is connected between terminals P47 and P48 of the driving circuit 47, and a coil 59 for actuating the right leg is connected between the terminals 47 and 49. The driving circuit 47, the driving control circuits 51, 53 and 55,, the coil 57, the coil 59, and a driving mechanism portion as described later constitute the actuating means 15 (FIGS. 1–3), and the actuating means 15 actuates the passive toy unit 1*a*. The driving circuit 47 is connected to a power source circuit 61. The power source circuit 61 comprises a battery VE, a booster circuit, etc., and boosts a battery voltage of 2.4 V to 5 V and supplies it to the driving circuit 47.

The construction of the circuit portion installed in the other passive toy units 1*b*, 1*c*, . . . , 1*n* is identical to that installed in the passive toy unit 1*a*, hence a detailed description thereof is omitted.

Further, in the embodiment as shown in FIG. 5, the synchronizing signal is transmitted from the synchronizing signal transmitting means 5 in the transmitter 4*a* to the other transmitters 4*b*, 4*c*, . . . , 4*n* through the signal line 23. In place of this construction, if transmission of the synchronizing signal to the other transmitters 4*b*, 4*c*, . . . , 4*n* is performed using an infrared beam of predetermined wavelength, no signal line 23 for connecting the transmitters 4*a*, 4*b*, . . . , 4*n* to one another is required, and thus the operation of each transmitter can be more freely performed.

Figure 1A:
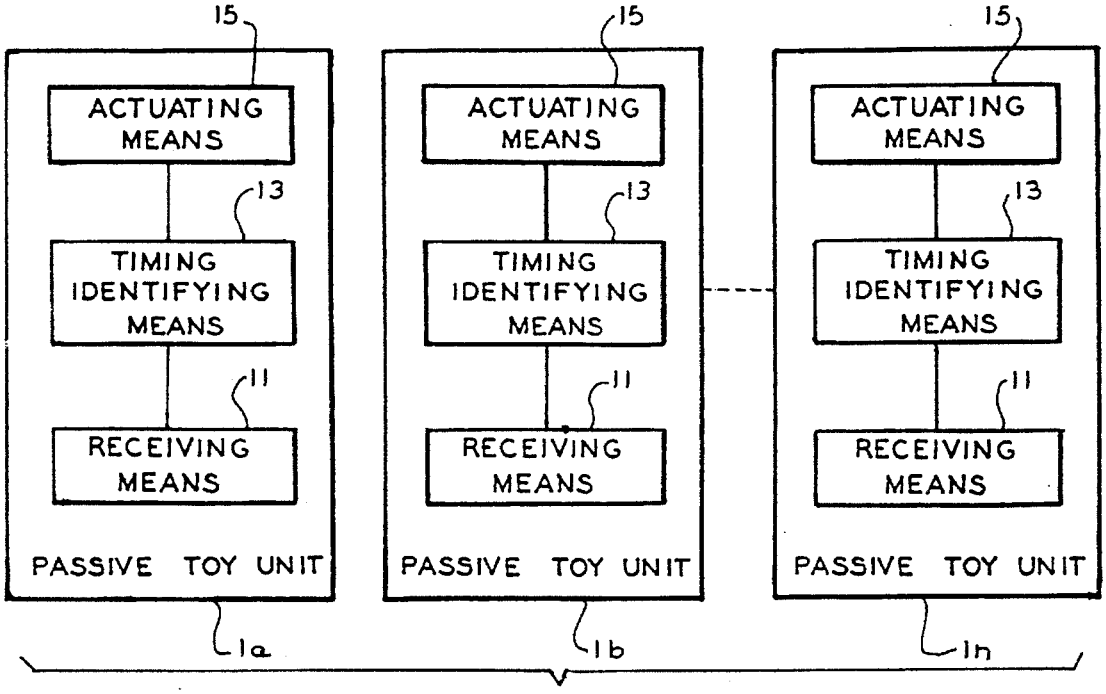
FIG. 1 is a block diagram illustrating the components of the passive toy units, transmitters and a synchronizing signal transmitting means of a first embodiment of a remote controllable toy according to the present invention.
Figure 1B:
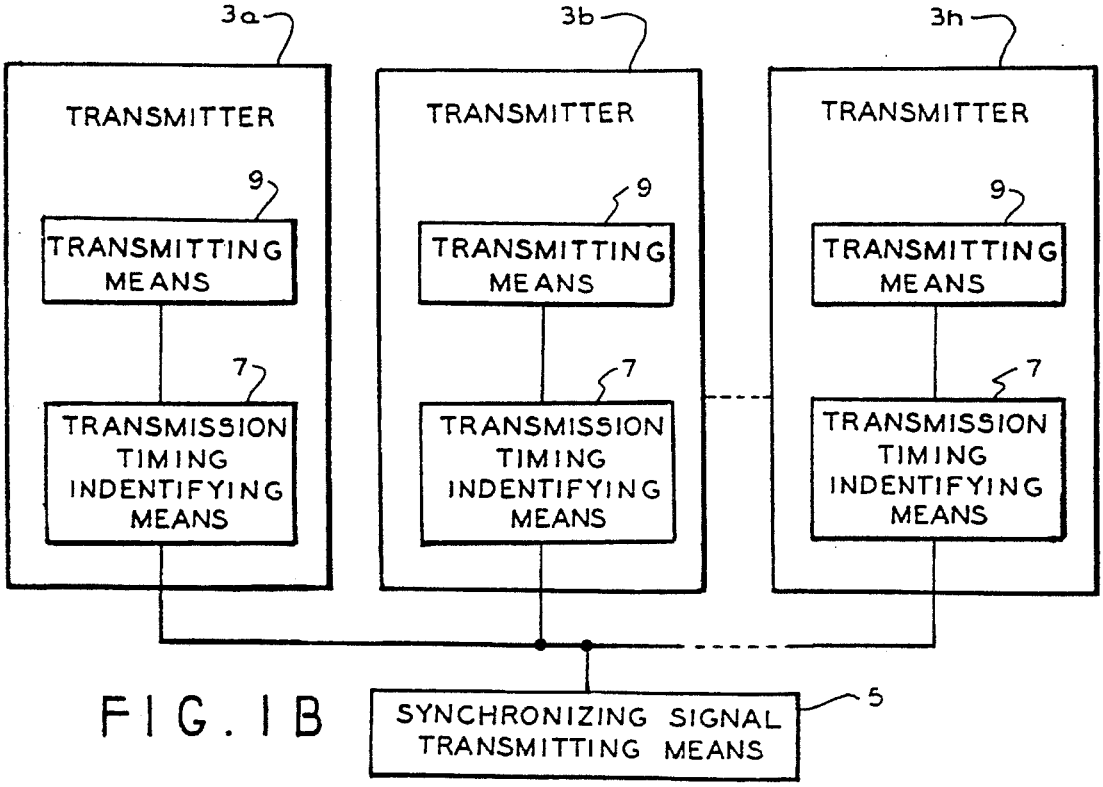
Figure 2A:
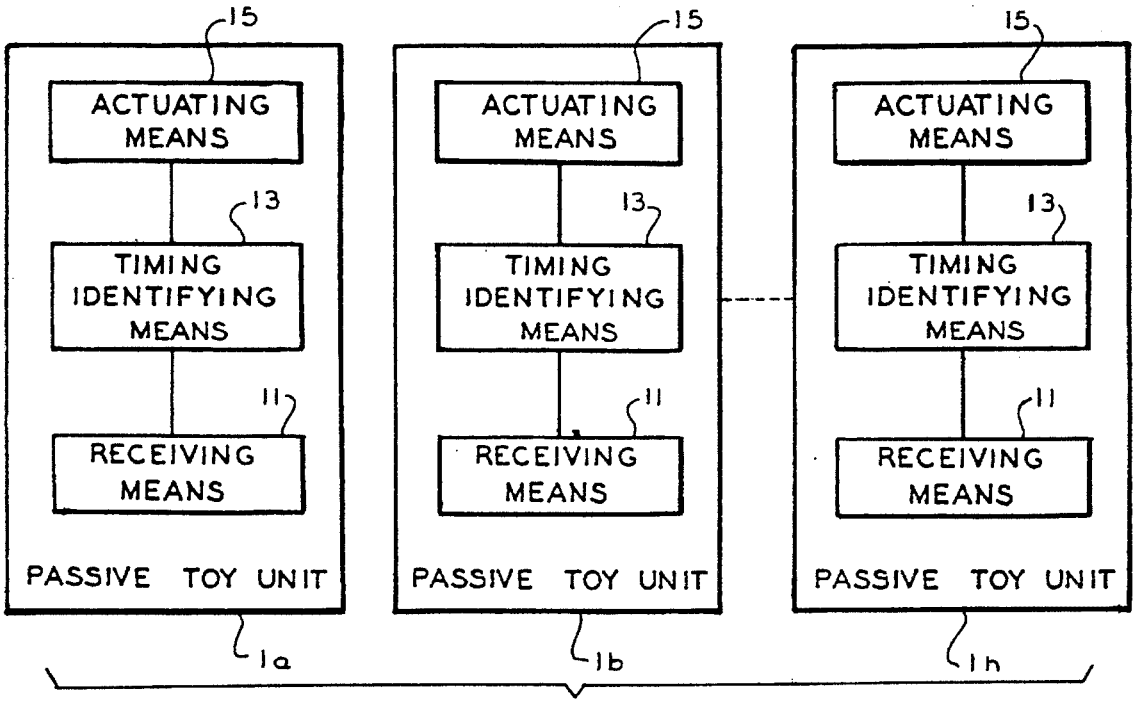
FIG. 2 is a block diagram illustrating the components of the passive toy units and the transmitters of a second embodiment of a remote controllable toy according to the present invention.
Figure 2B:
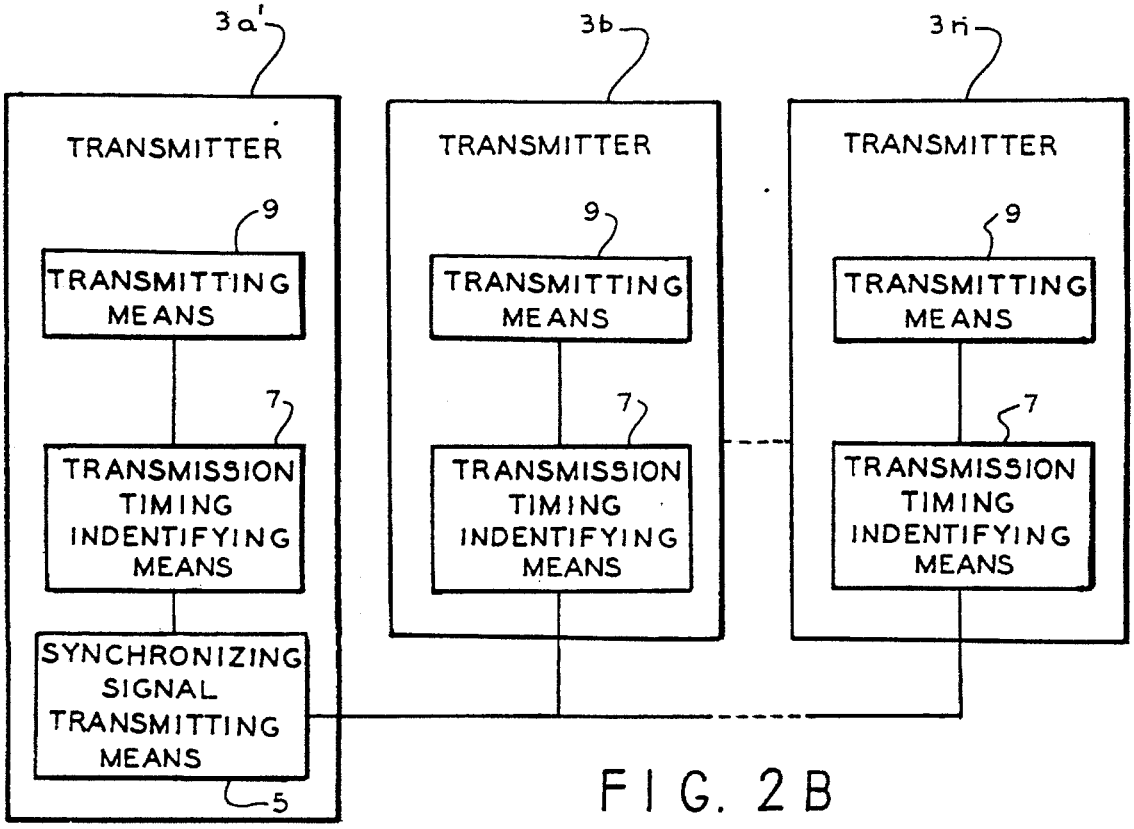
Figure 3A:
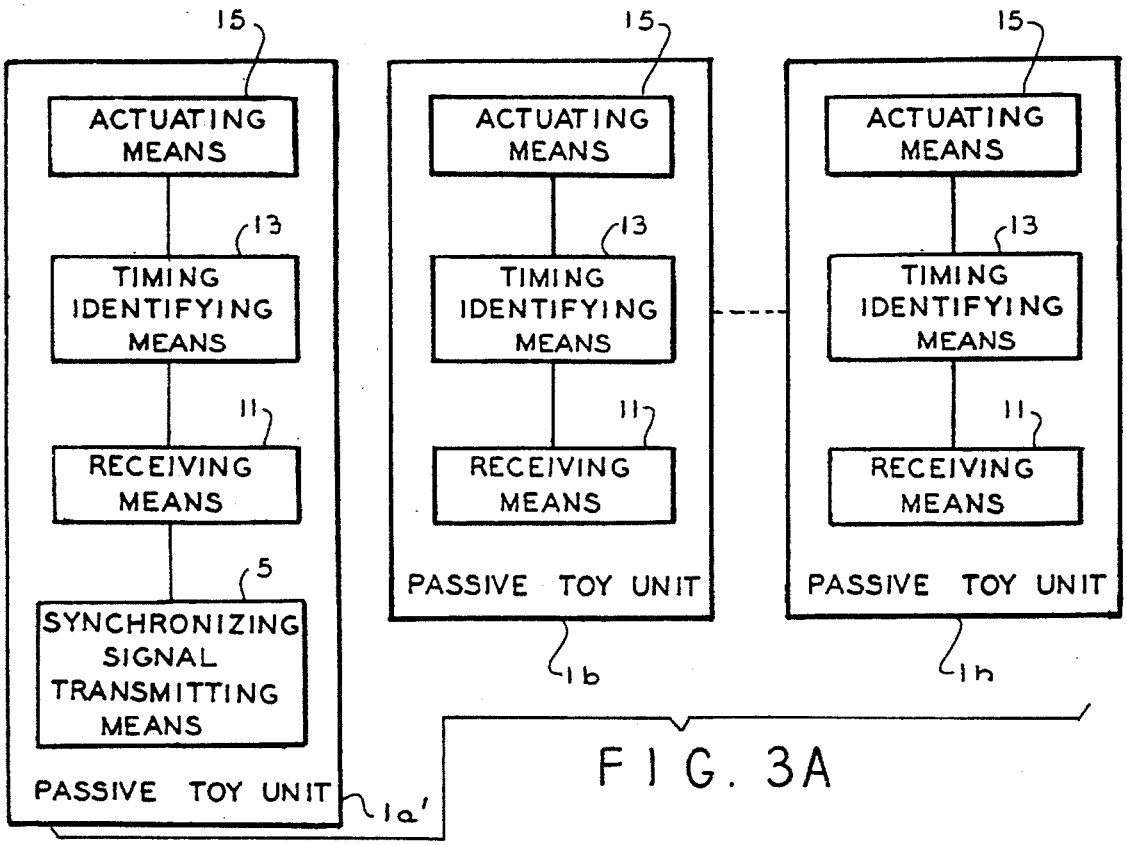
FIG. 3 is a block diagram illustrating the components of the passive toy units and transmitters of a third embodiment of a remote controllable toy according to the present invention.
Figure 3B:
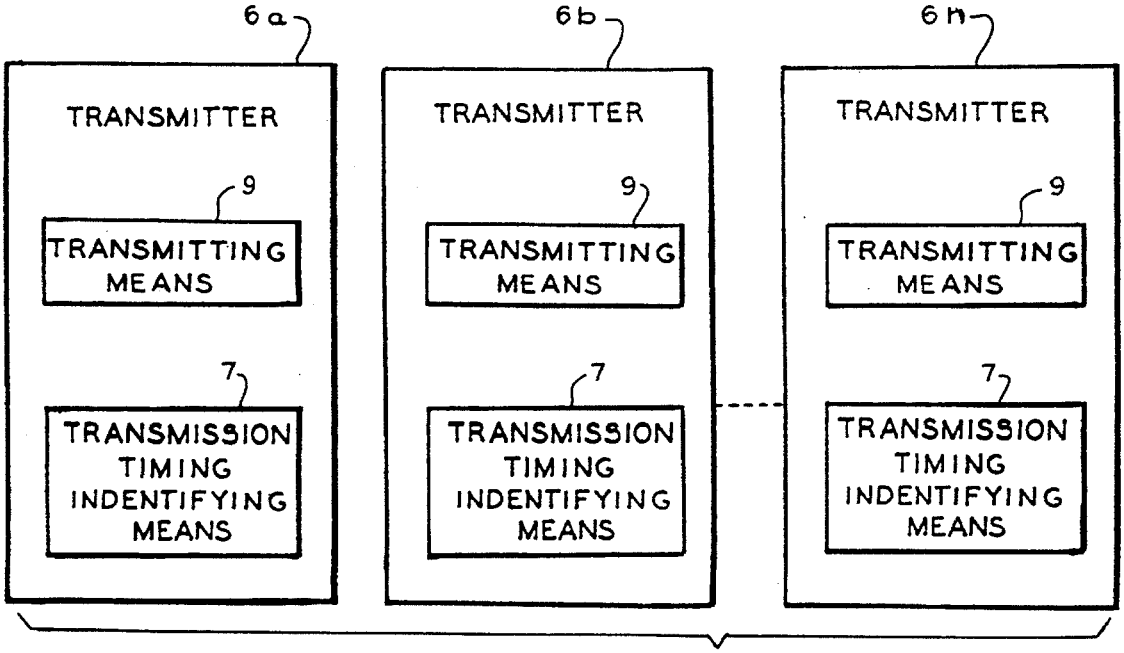

Still further, as shown in FIGS. 7 and 8, the synchronizing signal and infrared beam control signal having predetermined wavelength are transmitted or received using the light emitting element 25 (FIG. 7) and the light receiving element 27 (FIGS. 1–3). However, this invention is not limited to the signal transmission and reception scheme as described above, and the transmission or reception of the synchronizing signal and control signal may be performed using electromagnetic waves.

Figure 9:
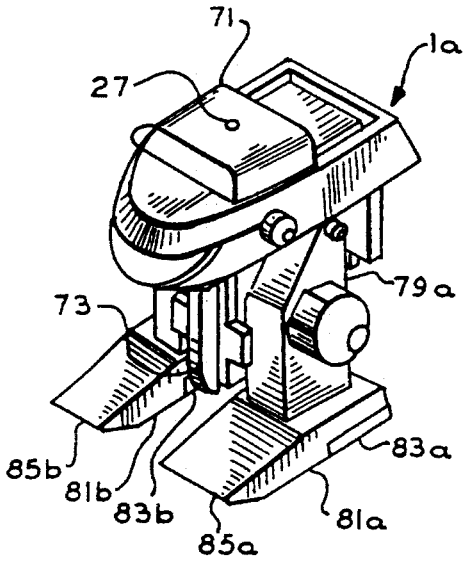
FIG. 9 is a perspective view of a representative passive toy unit.
Figure 10:
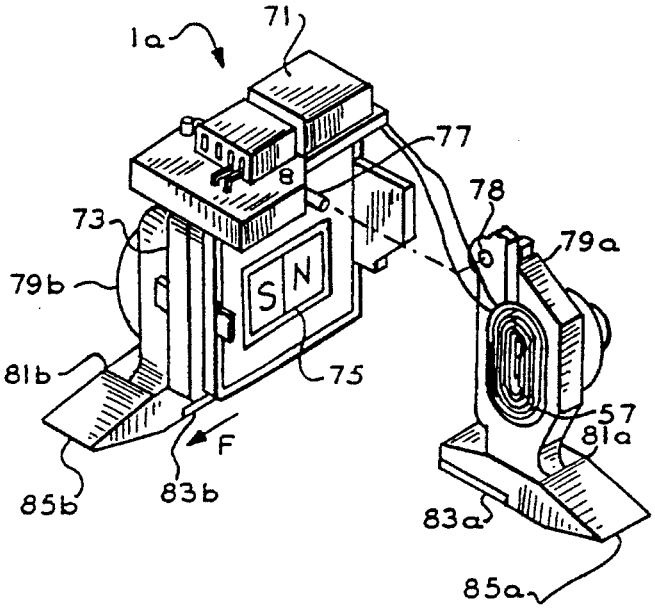
FIG. 10 is a perspective view of the passive toy unit of FIG. 9 with the head portion removed and a leg portion detached.

Next, the construction of the driving mechanism portion of the passive toy unit la will be described with reference to FIGS. 9 and 10.

A light receiving element 27 is provided at the upper portion of a head portion 71 of the passive toy unit 1*a*, and various circuits such as a signal processing circuit, etc. are provided inside the head portion 71. A battery is loaded at the lower side of the head portion 71. A plate-shaped permanent magnet 75 is fixed inside a body portion 73 located at a substantially central portion of the passive toy unit 1*a*. The permanent magnet 75 is formed of a rare earth metal magnet, and the S-poles and N-poles thereof are arranged along an advance (moving) direction indicated by the arrow F. For example, as shown in FIG. 10, the S-poles are arranged at the front side of the advance direction of F, and the N-poles are arranged at the rear side of the advance direction. A pair of swing shafts 77 are installed at the upper side of the permanent magnet 75 and at the left and right side surfaces of the body portion 73, and holes 78 are formed at the upper portion of the leg portions 79*a* and 79*b* in correspondence with the pair of swing shafts 77. The swing shaft 77 is inserted into the holes 78 such that the pair of leg portions 79*a* and 79*b* are swingable or pivotable around the swing shaft 77. Further, the pair of leg portions 79*a* and 79*b* are provided with coils 57 and 59 respectively. These coils 57 and 59 are located so as to face the permanent magnet 75. Foot portions 81*a* and 81*b* are provided at the lower ends of the pair of leg portions 79*a* and 79*b* respectively, and the rear portions of the foot portions 81*a* and 81*b* are provided with ground-contact portions 83*a* and 83*b* formed of rubber or the like which has a relatively large friction coefficient with respect to ground-contact or other surfaces over which the passive toy unit la operates. Further, the front portions 85*a* and 85*b* of the foot portions 81*a* and 81*b* are formed so as to be pointed in the advance direction F and slant upwardly toward the advance direction.

The driving mechanism portion of each of the other passive toy units 1*b*, 1*c*, . . . , 1*n* has the same construction as the passive toy unit 1*a*, and a detailed description thereof is omitted.

Figure 11:
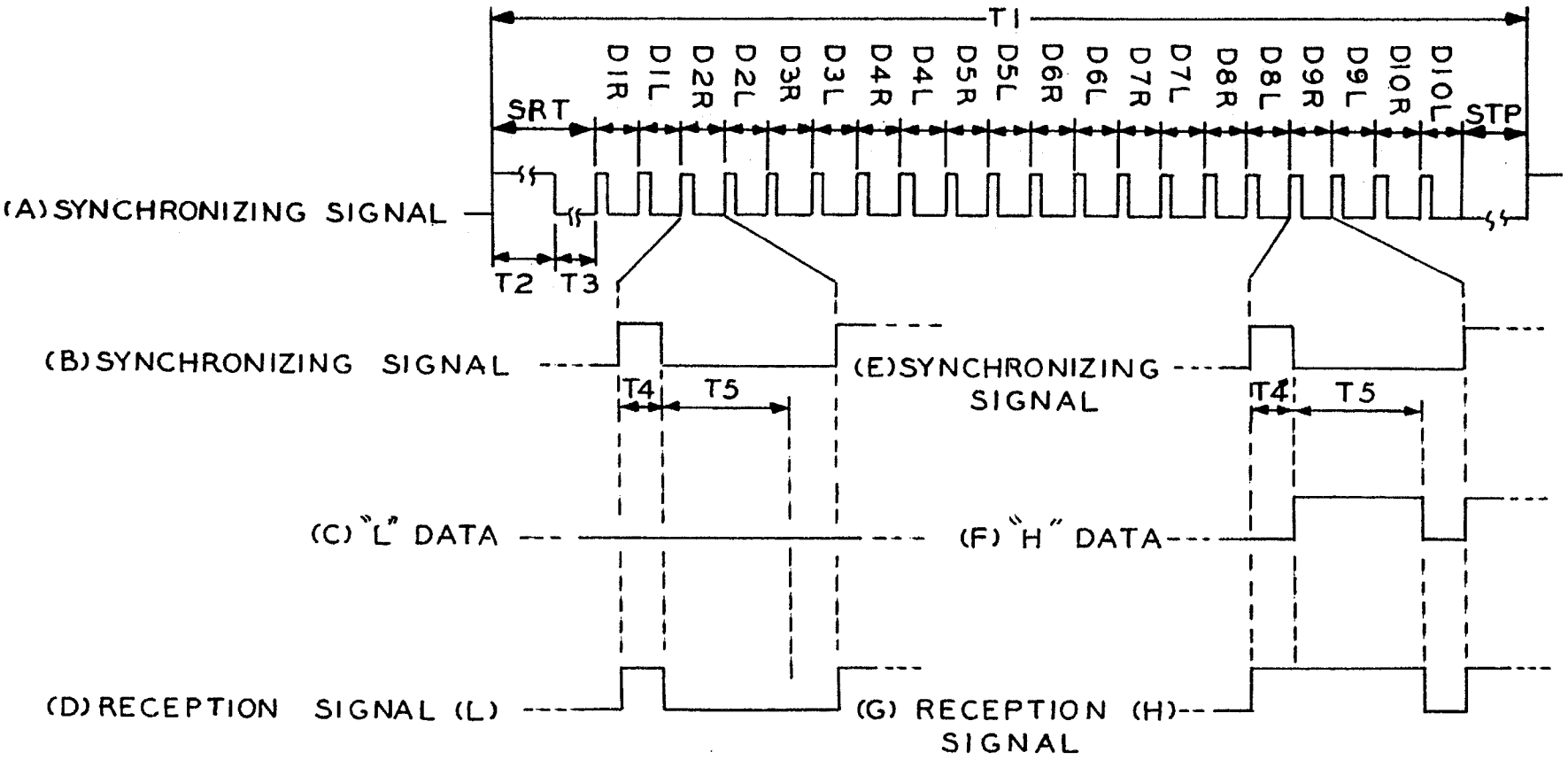
FIG. 11 is a signal waveform diagram showing waveforms of a synchronizing signal, data corresponding to the synchronizing signal and a reception signal.

Next, the operation of the invention will be described with reference to the signal waveforms of FIG. 11.

FIG. 11(A) shows the waveform of a synchronizing signal which is set when 10 sets of transmitters and passive toy units allocated with numbers NO1 to NO10 are used. This synchronizing signal comprises the start code SRT, data D1R, D1L, D2R, D2L, D3R, D3L, . . . , D10R, D10L and a stop code STP. For example, whole length T1 of the synchronizing signal is set to 80 mS, the length T2 of the positive pulse of the start code SRT is set to 5 mS, the length T3 of the negative pulse thereof is set to 1 mS, and the length of each of the data D1R, D1L, D2R, D2L, D3R, D3L, . . . , D10R, D10L is set to 15 mS; such synchronizing signal is repeatedly transmitted.

The data D1R, D2R, D3R, . . . , D10R are associated with data for the actuation of the right leg portions 79*b* of the respective passive toy units, and the data D1L, D2L, D3L, . . . , D10L are associated with data for the actuation of the left leg portions 79*a* of the respective passive toy units. For example, the data D1R and D1L are allocated to the transmitter 4*a* having the number NO1 and the passive toy unit 1*a* having the number NO1, the data D2R and D2L are allocated to the transmitter 4*b* having the number NO2 and the passive toy unit 1*b* having the number NO2, and the data D3R and D3L are allocated to the transmitter 4*c* having the number NO3 and the passive toy unit 1*c* having the number NO3. Likewise, the pairs of data associated with the actuation of the right leg portion 79*b* and the left leg portion 79*a* are allocated to the transmitter and the passive toy unit which have the corresponding number NO. Such an allocating operation is performed by setting the slide switches SS1 to SS9 of the respective transmitters or by setting the switches SW13 to SW15 of the respective passive toy units.

Further, as shown in the enlarged view of FIGS. 11(B) to (G), the pulse width T4 of each synchronizing signal is set to 510 microseconds, and a period T5 for which a control signal for controlling the passive toy unit is transmitted is set to 1477 microseconds, for example.

Next, for example, the operation of the right leg portion 79*b* of a passive toy unit having the number NO9 will be described with reference to FIGS. 2, 5, 11 and 12; in this example the passive toy unit having number N09 will be unit 1*b* of FIG. 5 and the corresponding transmitter having number N09 will be transmitter 3*b* of FIG. 5, and the transmitter 3*a*' including the synchronizing signal transmitter means 5 as noted above will be transmitter N01.

The synchronizing signal as shown in FIG. 11(A) is transmitted from the transmitter 3*a* to the other transmitters 3*b*, 3*c*, . . . , 3*n* and the passive toy units 1*a*, 1*b*, 1*c*, . . . , 1*n*.

When the switch SW1 of the transmitter 4*b* having the number NO9 is manipulated, the number of pulses of the synchronizing signal is counted, and the transmission timing (the timing corresponding to the data D9R) allocated to itself is identified on the basis of the count value. At this transmission timing,"H" data as shown in FIG. 11(F), that is, the control signal for actuating the right leg portion 79*b* of the passive toy unit 1*b* having the number NO9 is transmitted through its light emitting element 25 (FIG. 5) to the plurality of passive toy units 1*a* . . . , 1*n*. Accordingly, passive toy unit 1*b* having the number NO9 receives the synchronizing signal shown in FIG. 11(E) from the transmitter 4*a* having the number NO1, and also receives the control signal of "H" data as shown in FIG. 11(F) from the transmitter 3*b* having the number NO9. As a result, the receiving means 11 (FIG. 2) of the passive toy unit 1*b* having the number NO9 receives a reception signal comprising a combination of the synchronizing signal and the control signal as shown in FIG. 11(G).

Upon input of the synchronizing signal as shown in FIG. 11(A), the integrated circuit 41 of the passive toy unit 1*b* having the number NO9 counts the pulse number of the synchronizing signal which is input subsequently to the start code SRT, and identifies the timing, or period of operation, allocated thereto (the timing corresponding to the data D9R). When the data input at the timing, or period of operation, allocated to itself is "H" data as shown in FIG. 11(F), the integrated circuit 41 determines that the data corresponds to the control signal for actuating the right leg portion 79*b* of unit 1*b*.

Figure 12:
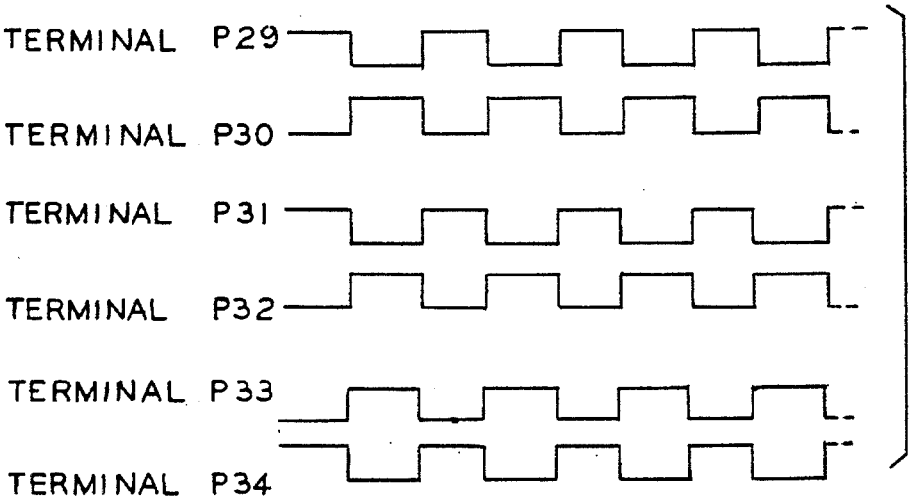
FIG. 12 is a waveform diagram of a pulse signal to be output when only a left leg portion of the passive toy unit is operated.

When the integrated circuit 41 identifies the control signal for actuating the right leg portion 79*b*, a predetermined period of pulse signal as shown in FIG. 12 is output from the terminals P29 to P34 of the integrated circuit 41. When a negative pulse is output from the terminals P29 and P34, power is supplied from the terminal P47 of the driving circuit 47, and the terminal P49 is grounded, so that a current flows through the coil 59 in the direction FRD as shown in FIG. 8.

When a negative pulse is output from the terminals P30 and P33 at a next period, power is supplied from the terminal P49 of the driving circuit 47, and the terminal P49 is grounded, so that a current flows through the coil 59 in the direction FRU as shown in FIG. 8.

Likewise, the direction of the current flowing into the coil 59 at the right leg portion side is varied at a constant period. As a result, the right leg portion 79b is swung by magnetic action between the coil 59 and the permanent magnet 75. Through this operation, passive toy unit 1b having the number NO9, in this example, is rotated counterclockwise to perform a game or play function.

Next, the operation of the left leg portion 79a of passive toy unit 1b having the number NO9, in this example, will be described with reference to FIGS. 2, 5, 11 and 13.

When the switch SW2 of transmitter 4b having the number NO9 is manipulated, the number of pulses of the synchronizing signal is counted, and the transmission timing (the timing corresponding to the data D9L) allocated to itself is identified on the basis of the count value to cause transmitter 3b to transmit the control signal for actuating the left leg portion 79a of the passive toy unit 1b having the number NO9 through the light emitting element 25 of transmitter 3b to the plurality of passive toy units 1a, 1b, . . . , 1n.

Upon reception of the synchronizing signal as shown in FIG. 11(A), the integrated circuit 41 of passive toy unit 1b having the number NO9 counts the pulse number of the synchronizing signal which is input subsequent to the start code SRT and identifies the timing, or period of operation, allocated thereto (the timing corresponding to the data D9L). The integrated circuit 41 identifies the control signal for actuating the left leg portion 79a on the basis of the data input at the timing, or period of operation, allocated to itself.

Figure 13:
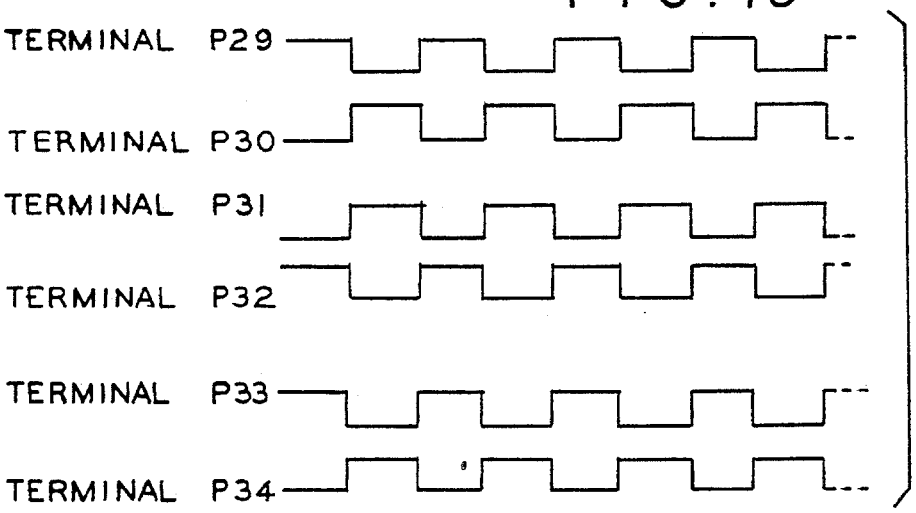
FIG. 13 is a waveform diagram of a pulse signal to be output when only a right leg portion of the passive toy unit is operated.

When the integrated circuit 41 identifies the control signal for actuating the left leg portion 79a, a predetermined period of pulse signal as shown in FIG. 13 is output from the terminals P29 to P34 of the integrated circuit 41. When a negative pulse is output from the terminals P29 and P32, power is supplied from the terminal P47 of the driving circuit 47, and the terminal P49 is grounded, so that a current flows in the coil 57 in the direction FLD as shown in FIG. 8.

When a negative pulse is output from the terminals P30 and P31 at a next period, power is supplied from the terminal P48 of the driving circuit 47, and the terminal P47 is grounded, so that a current flows in the coil 57 in the direction FLU as shown in FIG. 8.

Likewise, the direction of the current flowing into the coil 57 at the left leg portion side is varied at a constant period. As a result, the left leg portion 79b is swung by magnetic action between the coil 59 and the permanent magnet 75. Through this operation, passive toy unit 1b having the number NO9 in this example is rotated clockwise to perform a game or play function.

Next, the operation of advancing passive toy unit 1b having the number NO9, in this example, will be described with reference to FIGS. 2, 5, 11 and 14.

When the switches SW1 and SW2 of transmitter 3b having the number NO9 are simultaneously manipulated, the pulse number of the synchronizing signal is counted, and the transmission timing, or period of operation, allocated to itself (the timing corresponding to the data D9R, D9L) is identified, so that the control signals for actuating the operation of the right and left leg portions 79a and 79b of passive toy unit 1b having the number NO9 are transmitted to the plurality of passive toy units 1a . . . , 1n through the light emitting element 25 of transmitter 3b (FIG. 5).

Upon input of the synchronizing signal as shown in FIG. 11(A), the integrated circuit 41 of passive toy unit 1b having the number NO9 counts the pulse number of the synchronizing signal which is input subsequently to the start code SRT, and identifies the timing, or period of operation, allocated to itself (the timing corresponding to the data D9R,D9L). The integrated circuit 41 judges on the basis of the data D9R, D9L input at the timing, or period of operation, allocated to itself that the data corresponds to the control signal for actuating the right and left leg portions 79a and 79b of unit 1b.

Figure 14:
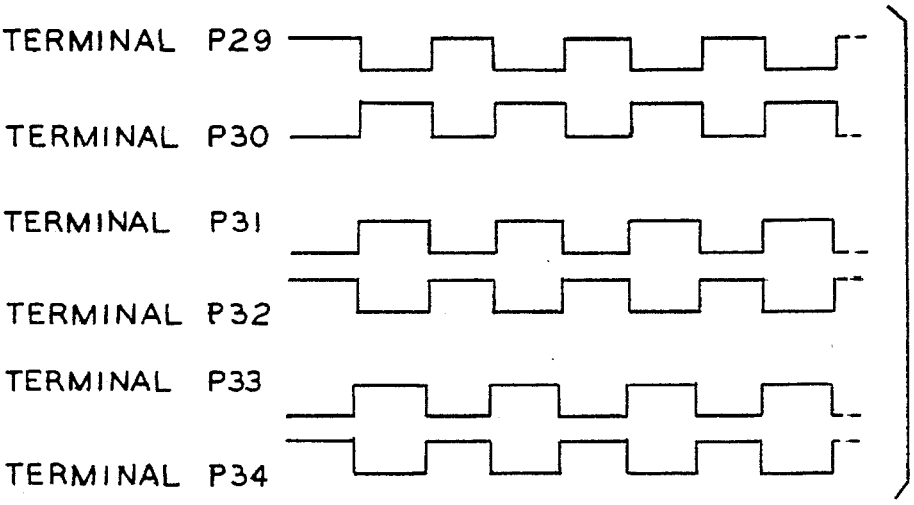
FIG. 14 is a waveform diagram of a pulse signal to be output when the passive toy unit is advanced.

When the integrated circuit 41 identifies the control signal for actuating the right and left leg portions 79a and 79b, a predetermined period of pulse signal as shown in FIG. 14 is output from the terminals P29 to P34 of the integrated circuit 41. As described above, the direction of the current flowing in the coil 57 at the right leg portion side and the direction of the current flowing in the coil 59 at the left leg portion side are varied every period. As a result, the right and left leg portions 79a and 79b are swung by the magnetic action between the coils 57 and 59 and the permanent magnet 75. Through this operation, passive toy unit 1b having the number NO9 can be advanced to perform a game or play function.

The above-described operations are performed to actuate any of the other passive toy units. That is, when any one of the switches SW1, SW2 and SW3 of the corresponding transmitter is manipulated, the transmitter counts the pulse number of the synchronizing signal, and identifies the transmission timing, or period of operation, allocated to itself on the basis of the count value to transmit the control signal for actuating the corresponding passive toy unit. When the integrated circuit 41 of the corresponding passive toy unit counts the pulse number of the synchronizing signal and identifies the timing, or period of operation, allocated to itself on the basis of the count value, the integrated circuit 41 outputs a predetermined period of pulse signal from the terminals P29 to P34 on the basis of the data input at the timing, or period of operation, allocated to itself. Through this operation, the corresponding leg portion is swung.

Further, when the switch SW3 of any transmitter is manipulated, the integrated circuit 41 of the corresponding passive toy unit sets a shorter period for the pulse signal to be output from the terminals P29 to P34, so that the actuation of the corresponding passive toy unit can be speeded up.

Still further, when the switch SW11 of any passive toy unit is manipulated, the integrated circuit 41 of the corresponding passive toy unit outputs the positive pulse signal from all the terminals P29 to P34 to forcibly stop the actuation of the passive toy unit and half the game or play functions.

As described above, according to the first aspect or embodiment of this invention, e.g. FIG. 4, the remote controllable toy includes a plurality of passive toy units, a plurality of transmitters for remotely controlling the respective passive toy units, and a synchronizing signal transmitting means for transmitting the synchronizing signal to the passive toy units and the transmitters, and each of the transmitters can transmit the control signal for controlling the corresponding passive toy unit only when it identifies the transmission timing, or period of operation, allocated to itself by referring to the synchronizing signal. Each of the passive toy units receives both of the synchronizing signal and the control signal, and identifies the timing, or period of operation, allocated to itself by referring to the received synchronizing signal, whereby it is actuated in accordance with the control signal received within the timing, or period of operation, allocated to itself. Therefore, the plurality of passive toy units can be individually and substantially simultaneously remote-controlled using infrared beams of single wavelength. Accordingly, the same transmission circuit can be installed in each transmitter, and the same reception circuit can be installed into each passive toy unit, so that the manufacturing process can be simplified and an increase in the manufacturing cost can be alleviated.

Further, since the plurality of passive toy units are individually and substantially simultaneously remote-controlled, the remote controllable toy of this invention is applicable particularly to a game in which the passive toy units compete against one another in strength and speed by being remote-controlled.

According to the second aspect or embodiment of this invention, e.g. FIG. 5, the remote controllable toy includes a plurality of passive toy units, a plurality of transmitters for remotely controlling the corresponding passive toy units and wherein the synchronizing signal transmitting means is provided in any one of the transmitters. Therefore, the construction of the apparatus can be simplified, and the overall cost can be further reduced.

Each of the transmitters transmits the control signal for controlling the corresponding passive toy unit only when it identifies the transmission timing, or period of operation, allocated thereto by referring to the synchronizing signal. At this time, each of the passive toy units receives both the synchronizing signal and the control signal, and identifies the timing, or period of operation, allocated to itself by referring or responding to the synchronizing signal so that it is actuated in accordance with the control signal received within the timing, or period of operation, allocated thereto. Therefore, the plurality of passive toy units can be individually and substantially simultaneously remote-controlled using an infrared beam of single wavelength. Accordingly, the same transmission circuit can be installed in each of the transmitters, and the same reception circuit can be installed in each of the passive toy units, so that the manufacturing process can be simplified and an increase in manufacturing cost can be alleviated.

Further, since the plurality of passive toy units are individually and substantially simultaneously remote-controlled, the remote controllable toy of this invention is applicable particularly to a game in which the passive toy units compete against one another in strength and speed by being remote-controlled.

According to the third aspect or embodiment of this invention, e.g. FIG. 6, the remote controllable toy includes a plurality of passive toy units, and a plurality of transmitters for remotely controlling the respective passive toy units and wherein the synchronizing signal transmitting means is provided in any one of the passive toy units. Therefore, the construction of the apparatus can be simplified, and the overall cost can be further reduced.

Each of the transmitters transmits the control signal for controlling the corresponding passive toy unit only when it identifies the transmission timing, or period of operation, allocated thereto by referring to the synchronizing signal. At this time, each of the passive toy units receives both the synchronizing signal and the control signal, and identifies the timing, or period of operation, allocated to itself by referring or responding to the synchronizing signal so that it is actuated in accordance with the control signal received within the timing, or period of operation, allocated thereto. Therefore, the plurality of passive toy units can be individually and substantially simultaneously remote-controlled using an infrared beam of single wavelength. Accordingly, the same transmission circuit can be installed in each of transmitters, and the same reception circuit can be installed in each of the passive toy units, so that the manufacturing process can be simplified and an increase in the manufacturing cost can be alleviated.

Further, since the plurality of passive toy units are individually and substantially simultaneously remote-controlled, the remote controllable toy of this invention is applicable particularly to a game in which the passive toy units compete against one another in strength and speed by being remote-controlled.

What is claimed is:

1. A remote controllable toy including:

a plurality of passive toy units;

a plurality of transmitters for remotely controlling said passive toy units; and synchronizing signal transmitting means for transmitting a synchronizing signal to said passive toy units and said transmitters, wherein each of said transmitters includes transmission timing identifying means for identifying a transmission timing allocated thereto by referring to the synchronizing signal, and transmitting means for transmitting a control signal to control the corresponding passive toy unit only when said transmission timing identifying means identifies the transmission timing allocated thereto, and wherein each of the passive toy units includes receiving means for receiving the synchronizing signal and the control signal, timing identifying means for identifying the timing allocated thereto by referring to the received synchronizing signal, and actuating means which is operated in accordance with the control signal received within the timing allocated thereto.

2. A remote controllable toy including:

a plurality of passive toy units; and a plurality of transmitters for remotely controlling said passive toy units, wherein any one of said plurality of transmitters includes synchronizing signal transmitting means for transmitting a synchronizing signal to the other transmitters and said plurality of passive toy units, and wherein each of said transmitters has transmission timing identifying means for identifying a transmission timing allocated thereto by referring to the synchronizing signal and transmitting means for transmitting a control signal to control the corresponding passive toy unit only when said transmission timing identifying means identifies the transmission timing allocated thereto, and wherein each of the passive toy units includes receiving means for receiving the synchronizing signal and the control signal, timing identifying means for identifying the timing allocated thereto by referring to the received synchronizing signal, and actuating means which is operated in accordance with the control signal received within the timing allocated thereto.

3. A remote controllable toy including:

a plurality of passive toy units; and a plurality of transmitters for remotely controlling said passive toy units, wherein any one of said plurality of passive toy units includes synchronizing signal transmitting means for transmitting a synchronizing signal to the other passive toy units and said plurality of transmitters, wherein each of the transmitters has transmission timing identifying means for identifying a transmission timing allocated thereto by referring to the synchronizing signal and transmitting means for transmitting a control signal to control the corresponding passive toy unit only when said transmission timing identifying means judges the transmission timing allocated thereto, and wherein each of said passive toy units includes receiving means for receiving the synchronizing signal and the control signal, timing identifying means for identifying the timing allocated thereto by referring to the received synchronizing signal, and actuating means which is operated in accordance with the control signal received within the timing allocated thereto.

4. A remote controllable toy, comprising:

a plurality of passive toy units, each passive toy unit including control and synchronizing signal receiving means, timing identifying means for identifying the period of time during which each toy unit is to respond to the simultaneous receipt of control and synchronizing signals and actuating means responding to the simultaneous receipt of control and synchronizing signals to cause the toy unit to perform a game function;

a plurality of transmitters each associated with one of said passive toy units, each transmitter including control signal transmitting means for simultaneously transmitting a control signal to all of said toy units and transmission timing identifying means for identifying the period during which each transmitter transmits said control signal;

synchronizing signal transmitting means for simultaneously transmitting a synchronizing signal to all of said toy units and to all of said transmitters; and said transmitters and said synchronizing signal transmitting means transmitting said control and synchronizing signals at the same predetermined wavelength.

5. The remote controllable toy unit according to claim 4 wherein said synchronizing signal transmitting means is separate from said transmitters and said passive toy units.

6. The remote controllable toy unit according to claim 4 wherein said synchronizing signal transmitting means is included in one of said transmitters.

7. The remote controllable toy unit according to claim 4 wherein said synchronizing signal transmitting means is included in one of said passive toy units.

* * * * *